US010012485B1

(12) United States Patent
Emma et al.

(10) Patent No.: US 10,012,485 B1
(45) Date of Patent: Jul. 3, 2018

(54) INTEGRATED BURST DISC FOR HIGH/LOW PROPULSION ORDNANCE

(71) Applicant: Micron Products, Inc., Fitchburg, MA (US)

(72) Inventors: Salvatore Emma, Ashburnham, MA (US); James Kunz, Shrewsbury, MA (US); Robert Maguy, Fitchburg, MA (US); Andrew Santin, Beverly, MA (US)

(73) Assignee: MICRON PRODUCTS, INC., Fitchburg, MA (US)

( * ) Notice: Subject to any disclaimer, the term of this patent is extended or adjusted under 35 U.S.C. 154(b) by 0 days.

(21) Appl. No.: 15/433,093

(22) Filed: Feb. 15, 2017

(51) Int. Cl.
*F42B 5/30* (2006.01)
*F42B 12/20* (2006.01)
*F42B 30/04* (2006.01)

(52) U.S. Cl.
CPC ..... *F42B 5/30* (2013.01); *F42B 12/20* (2013.01); *F42B 30/04* (2013.01)

(58) Field of Classification Search
CPC ..... F42B 5/285; F42B 30/04; F42B 5/30
USPC ..... 102/445, 482, 446, 443, 469, 447, 439, 102/444, 470, 464, 466, 465
See application file for complete search history.

(56) References Cited

U.S. PATENT DOCUMENTS

| | | | | | |
|---|---|---|---|---|---|
| 3,688,699 | A * | 9/1972 | Horn | F42B 7/06 | 102/450 |
| 3,728,967 | A * | 4/1973 | Hinkle | F42B 5/08 | 102/202.6 |
| 4,958,568 | A * | 9/1990 | Buenemann | F42B 5/307 | 102/466 |
| 5,969,288 | A * | 10/1999 | Baud | F42B 5/313 | 102/466 |
| 6,041,712 | A * | 3/2000 | Lyon | F42B 5/02 | 102/439 |
| 2004/0011237 | A1* | 1/2004 | Khvichia | F42B 5/30 | 102/466 |
| 2007/0151473 | A1* | 7/2007 | Brunn | F42B 5/02 | 102/444 |

* cited by examiner

*Primary Examiner* — Reginald Tillman, Jr.
(74) *Attorney, Agent, or Firm* — Juan Carlos A. Marquez; Marquez IP Law Office, PLLC

(57) ABSTRACT

A rupture mechanism is integrated into a plastic casing used for low velocity projectile rounds. The casing incorporates a cylindrical wall having a top mouth end that fixedly receives a projectile to be launched, and a bottom base head at the bottom end. A low-pressure chamber is formed by a first interior space between the cylindrical wall and the bottom base head. A high-pressure chamber formed on the bottom base head extends into the first interior space. The high-pressure chamber is formed with a second interior space to receive an ammunition cartridge. A top portion of the high-pressure chamber has an integrated burst area wall with a thickness selectively formed based on a type of projectile fixed at the top mouth end. Detonation of propellant gas from the cartridge builds up pressure to rupture the integrated burst area wall with a delay time in rupturing the integrated burst area wall based on the thickness of the integrated burst area wall.

7 Claims, 7 Drawing Sheets

INTEGRATED BURST DISC FOR HIGH/LOW PROPULSION ORDNANCE

BACKGROUND OF THE INVENTION

This invention relates to ammunition rounds and more specifically to rounds which produce a low projectile velocity, as those rounds in which the projectile is a grenade. In any gun system which uses cartridge ammunition, the propellant is burned in a case behind the projectile and the hot gases generated thereby expand to propel the projectile from the case and along the gun bore. Where the projectile velocity is only a few to several hundred feet per second, it is generally impossible to obtain consistent muzzle velocities with conventional cartridges. This is because the rate of increase of the case volume is so rapid, as the projectile is propelled forwardly therein by the initial ignition, that a variable proportion of the propellant is driven along the gun bore after the projectile without being ignited. Thus, round to round combustion is inconsistent, resulting in a low reliability.

SUMMARY OF THE INVENTION

To overcome this problem, in the prior art, cartridges incorporating a high-low pressure system have been provided in which the propellant is loaded in a relatively small high pressure chamber, or blank cartridge of smaller caliber and inserted into the base of the casing. When the propellant is ignited, it remains contained in the high-pressure chamber or blank cartridge until the pressure generated therein reaches a level which assures that all of the propellant is ignited, then, a brass cap covering the propellant and closing the chamber ruptures at the opening of the high-pressure chamber or blank cartridge, thereby permitting the discharge gases to expand into a low-pressure chamber in back of the projectile which is propelled thereby from the case. However, because the construction of the casing requires the use of a brass cap mounted on a brass ammunition casing that then has to inserted the casing of the projectile, the manufacture and application of such a conventional system can be more complex, time consuming and costly.

It is a principal objective of this invention to integrate the conventional rupture mechanism which is typically found inserted into the brass casing of a blank cartridge and replace it with a system that is easier and cost effective to manufacture, and more versatile in its applications.

In at least one embodiment, the present invention is directed to a casing for a projectile round, comprising: a cylindrical wall having a top mouth end and bottom end, the top mouth end being open to fixedly receive a projectile to be launched; a bottom base head fixedly connected to the bottom end of the cylindrical wall; a low-pressure chamber formed by a first interior space defined by the cylindrical wall and the bottom base head; and a high-pressure chamber formed on the bottom base head and extending into the first interior space, the high-pressure chamber being further formed with a second interior space open to receive an ammunition cartridge from outside the high-pressure chamber, a top portion of the high-pressure chamber that extends into the first interior space having an integrated burst area wall with a predetermined thickness that is selectively formed based on a type of projectile fixedly received at the top mouth end, wherein detonation of propellant gas from the ammunition cartridge in the high-pressure chamber builds up pressure to rupture the integrated burst area wall and then propel the projectile, a delay time in the built-up pressure rupturing the integrated burst area wall being in response to the selectively formed thickness of the integrated burst area wall.

DESCRIPTION OF THE DRAWINGS

The foregoing summary, as well as the following detailed description of the invention, will be better understood when read in conjunction with the appended drawings. For the purpose of illustrating the invention, there are shown in the drawings the embodiment(s) which are presently preferred, including.

DETAILED DESCRIPTION OF THE PREFERRED EMBODIMENT

Figure 1:
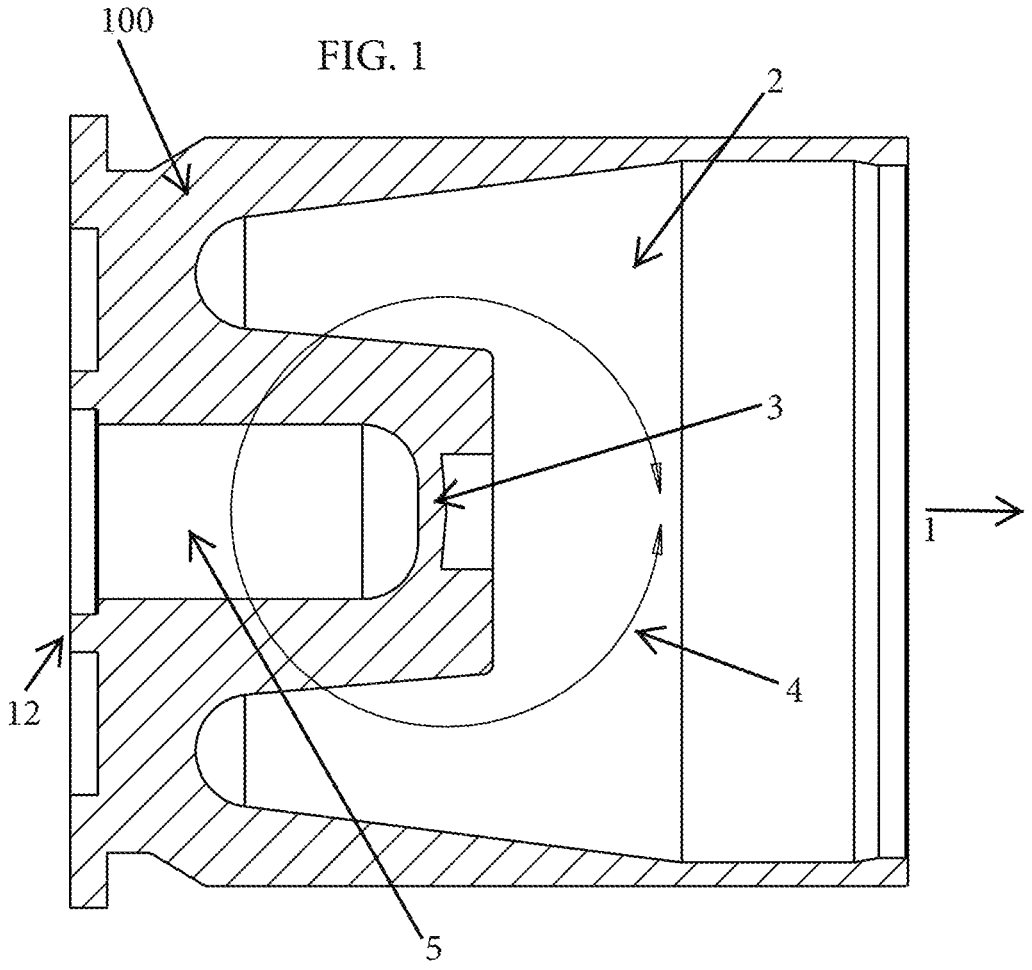
FIG. 1 shows cross section profile of a typical plastic casing applicable to the present invention.

The present description will be better understood from the following detailed description read in light of the accompanying drawings, wherein like reference numerals are used to designate like parts in the accompanying drawings. The descriptions of the various embodiments of the invention as discussed hereinbelow are for example only and not intended to limit the scope of the invention, its uses and variations of size, shape, material structure or assembly methods.

According to at least one embodiment of the present invention, FIG. 1 shows cross section profile of a plastic casing 100 typically used in a "high/low" pressure system usually found in 37 and 40 millimeter grenades typically launched in a shoulder fired or mounted grenade launcher. The casing 100 incorporates a low-pressure chamber 2 and depicts a machined Integrated Burst Area 1 which is a section of the casing 100 which has been machined to a thickness appropriate for the application. A high-pressure chamber 5 formed at the base head 12 at the bottom of the casing 100. During use, a blank casing with a propellant charge (not shown) is inserted into the chamber 5. The Integrated Burst Area wall 3 determines the direction 1 that a projectile (not shown) inserted into the casing 100 would take upon launch. Inset 4 depicting the area at the top end of the high-pressure chamber 5 and the Integrated Burst Area wall 3 is enlarged and represented in FIG. 2.

Figure 2:
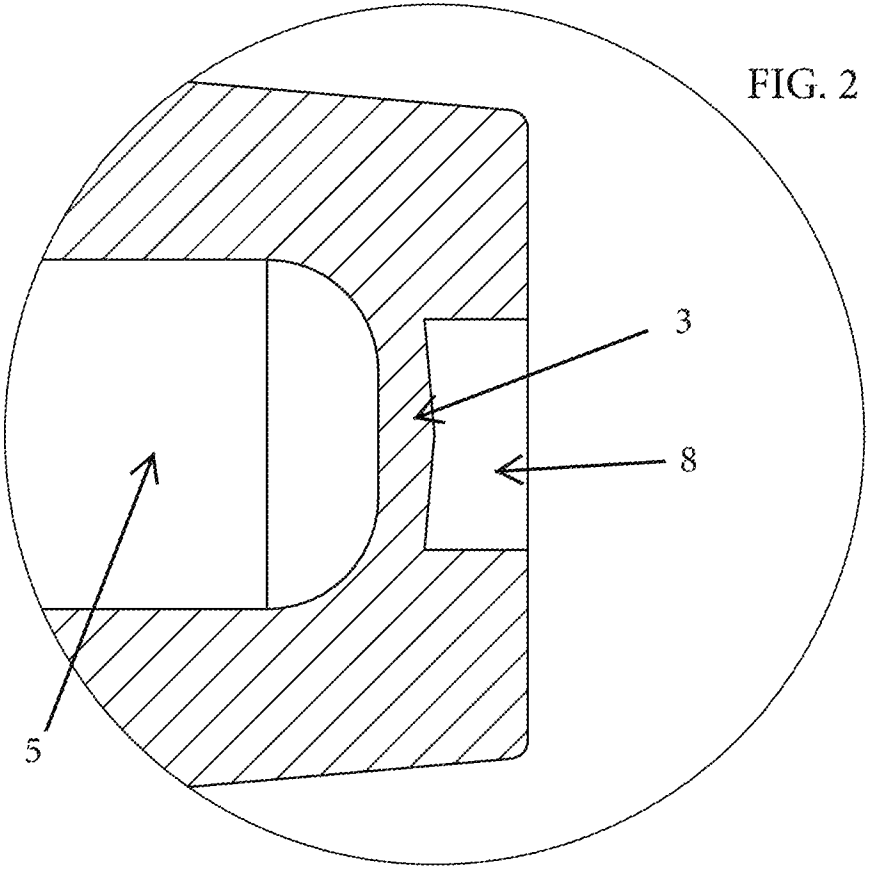
FIG. 2 depicts a larger representation of the Integrated Burst Area according to the present invention.

FIG. 2 depicts a larger representation of the Integrated Burst Area, showing the high-pressure chamber 5. The Integrated Burst Area wall 3 is the machined or milled area where material of the casing 100 is removed during manufacture to form the upper recess 8. This provides a certain thickness of the Integrated Burst Area wall 3.

Figure 1A:
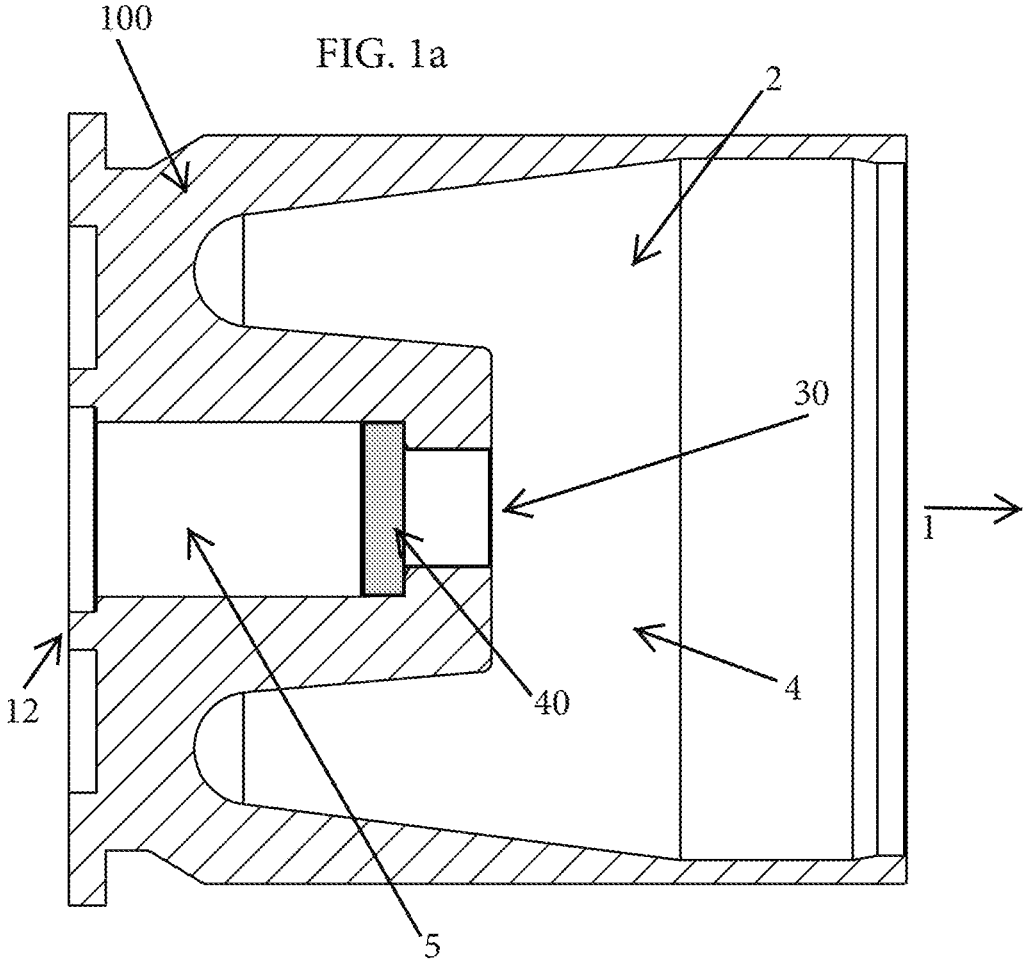
FIG. 1*a* shows a cross section profile of a typical plastic casing applicable to an alternative embodiment of the present invention.

FIG. 1*a* depicts an alternative embodiment of the present invention showing a component burst disc 40 which has been inserted into the high pressure chamber 5. In this embodiment, the high-pressure chamber is fabricated with an opening through an upper portion of the high-pressure chamber 5 into the low-pressure chamber 2. The component burst disc 40 is positioned in or adjacent to the opening to separate the high-pressure and low pressure chambers. The component burst disk 40 in this embodiment may be a disc fabricated from plastic or metal and may be of varying thicknesses to adjust the pressure at which the disc 40 bursts upon firing of the charge (not shown) thereby releasing expanding gasses from the high-pressure chamber 5 into the low-pressure chamber 2. The opening in the high-pressure chamber 5 may be formed by drilling or as part of a plastic injection molding of the casing 100.

Figure 3:
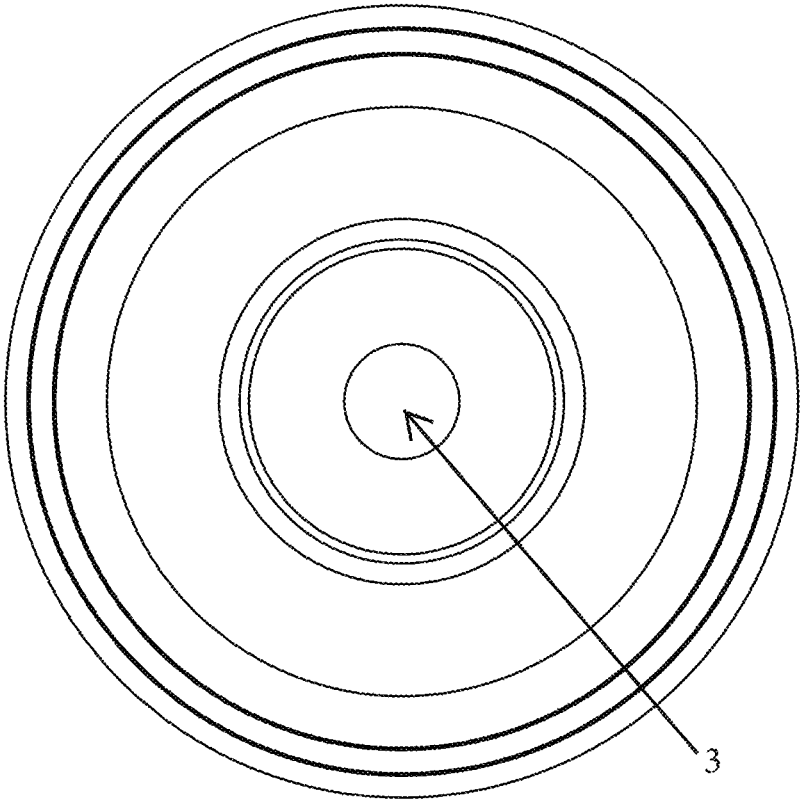
FIG. 3 depicts a top-down view of the open (mouth) side of the casing according to the present invention.

FIG. 3 depicts a top-down view of the open mouth side of the casing 100. The Integrated Burst Area wall 3, in at least one embodiment, may be formed by being machined from the top in a downward direction until an appropriate thickness of the Integrated Burst Area wall 3 is achieved.

Figure 4:
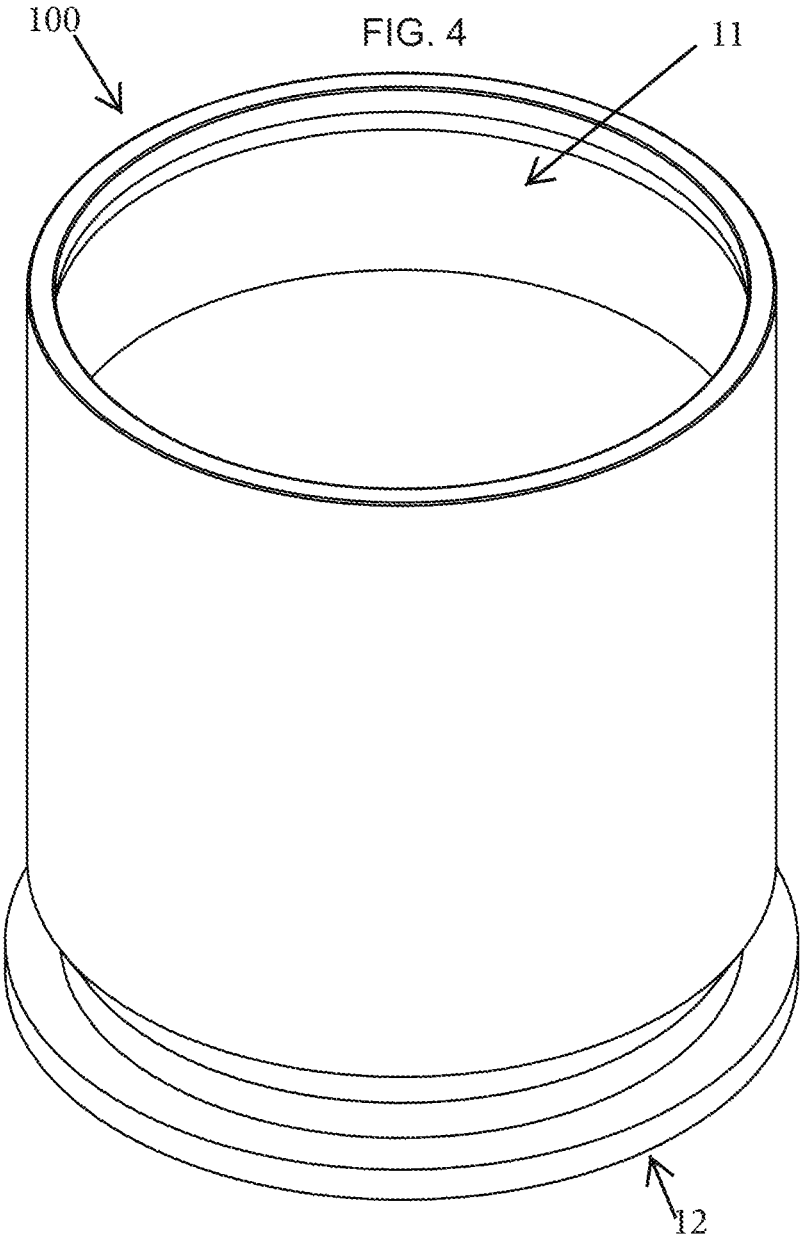
FIG. 4 depicts a projected 3-dimensional side view of a typical plastic casing applicable to the present invention.

FIG. 4 depicts a projected 3-dimensional side view of the plastic casing 100 applicable to the present invention that is typically found in 37/40 millimeter grenades launched in a shoulder fired or mounted grenade launcher.

Figure 5:
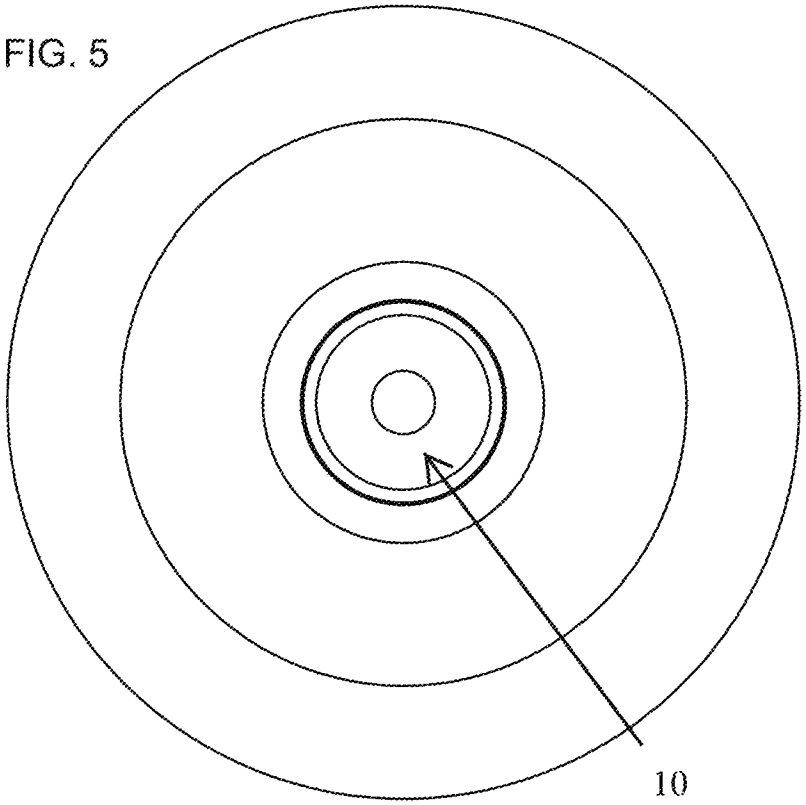
FIG. 5 shows a bottom perspective of the casing according to the present invention.

FIG. 5 shows a bottom perspective of the casing 100 shown with a blank charge 10 inserted into the bottom of the casing 100.

Figure 6:
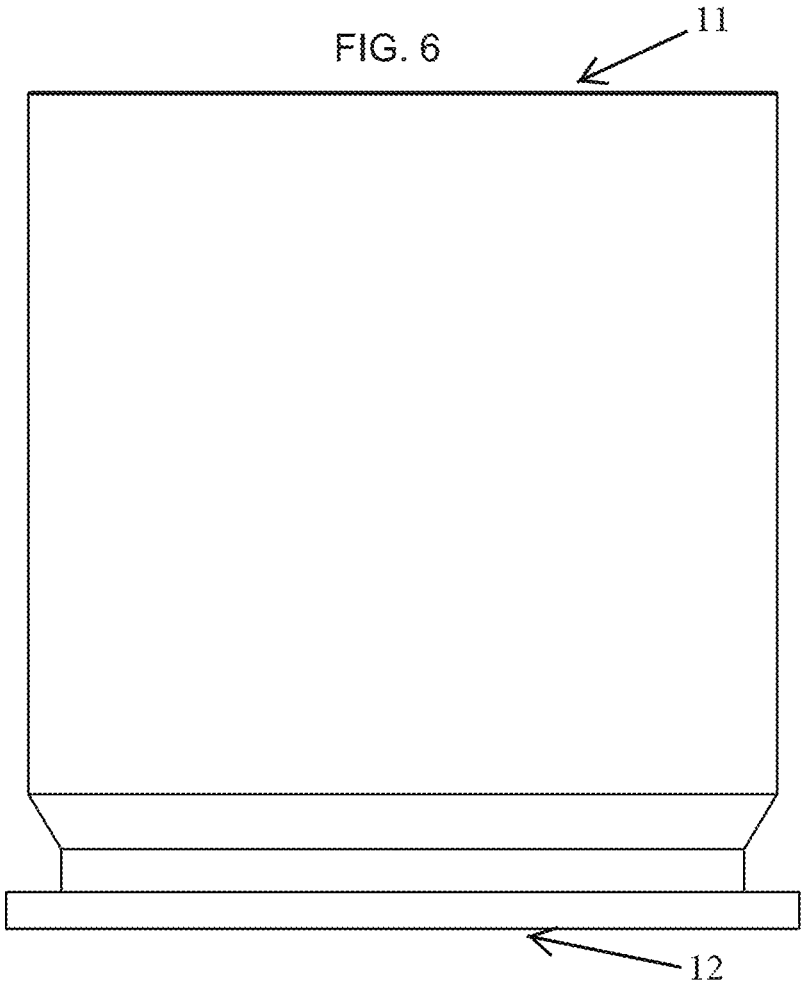
FIG. 6 shows a profile perspective of the casing according to the present invention.

FIG. 6 shows a profile perspective of the casing with the top opening 11 or "mouth" of the plastic casing 100 and the base head 12 of the casing 100 at the rearward or bottom side.

The present invention integrates the conventional rupture mechanism which is typically found inserted into the brass casing of a blank cartridge and replace it with an Integrated Burst Area wall 3 in the top of the high-pressure chamber 5 formed as part of the plastic casing 100. Typically, a blank cartridge is inserted into the base head 12 at the bottom or rearward side of the plastic casing 100, such as those used in 37/40 millimeter grenades. Instead of assembling the rupture mechanism into the blank cartridge (as currently done in the prior art), a conventional blank cartridge having a star or other crimp at the top is inserted into the high-pressure chamber 5 which extends into the interior of the casing 100. The top portion of the high-pressure chamber 5 includes a section of plastic that is, in one embodiment, milled to a specific thickness, thereby forming the Integrated Burst Area wall 3. The thickness of the Integrated Burst Area wall 3 is machined to an appropriate thickness so that the release of the propellant gas from the high-pressure chamber 5 where the propellant is ignited can build to a pressure great enough to break the Integrated Burst Area wall 3 and transfer pressure to the low-pressure chamber 2 forward of the high-pressure area 5 and behind the projectile (not shown) creating forward action in the direction 1. The forward action of the projectile is delayed for a period of time by the Integrated Burst Area wall 3 to assure complete ignition of the propellant in the blank casing, allow a build-up of pressure, thusly rupturing the Integrated Burst Area wall 3.

The materials used to fabricate the casing may be made from a variety of thermoplastic injection molded resins such as ABS, Nylon, Polypropylene, Teflon, Polycarbonate, etc. The injection molded resins may contain a glass or other fiber filler to strengthen the casing and prevent fracture under pressure. It is therefore necessary to mill the area of the Integrated Burst Area wall 3 to a thickness appropriate for the application and the material being used to fabricate the casing. For example, if a heavy projectile, and a more powerful load of 4-7 grains of propellant being used in the blank cartridge, the Integrated Burst Area wall 3 may be formed with a thickness of 30-50 thousandths of an inch. If a lightweight projectile is mounted in the casing 100 and a less powerful load of 3-5 grains of propellant used in the blank cartridge, the Integrated Burst Area wall 3 may be formed with a thickness of 20-40 thousandths of an inch.

The preferred embodiments of the present invention are described in the above-mentioned detailed description of the preferred embodiment. While these descriptions directly describe the embodiments, it is understood that those skilled in the art may conceive modifications and/or variations to the specific embodiment shown and described therein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art. The foregoing description of a preferred embodiment and best mode of the invention known to the applicant at the time of filing the application has been presented and is intended for the purposes of illustration and description. It is not intended to be exhausted or to limit the present invention to the precise form disclosed, and many modifications and variations are possible in the light of the above teachings.

We claim:

1. A casing for a projectile round, comprising:

a cylindrical wall having a top mouth end and bottom end, the top mouth end being open to fixedly receive a projectile to be launched;

a bottom base head fixedly connected to the bottom end of the cylindrical wall;

a low-pressure chamber formed by a first interior space defined by the cylindrical wall and the bottom base head; and a high-pressure chamber formed on the bottom base head and extending into the first interior space, the high-pressure chamber being further formed with a second interior space open to receive an ammunition cartridge from outside the high-pressure chamber, a top portion of the high-pressure chamber that extends into the first interior space having an integrated burst area wall with a predetermined thickness that is selectively formed based on a type of projectile fixedly received at the top mouth end, wherein detonation of propellant gas from the ammunition cartridge in the high-pressure chamber builds up pressure to rupture the integrated burst area wall and then propel the projectile, a delay time in the built-up pressure rupturing the integrated burst area wall being in response to the selectively formed thickness of the integrated burst area wall, the thickness of the integrated burst wall being selectively formed based on a weight of the projectile and a predetermined velocity of the projectile.

2. A casing according to claim 1, wherein the top portion of the high-pressure chamber extending into the first interior space includes a recess having a depth selectively formed to determine the thickness of the integrated burst area wall between the high-pressure chamber and the low-pressure chamber.

3. A casing according to claim 2, wherein the recess is selectively milled to form the predetermined thickness of the integrated burst area wall.

4. A casing according to claim 1, wherein the top portion of the high-pressure chamber extending into the first interior space includes an opening defined to fluidly connect the low-pressure chamber to the high-pressure chamber, and the integrated burst area wall is a component burst disc fixedly positioned at least one of adjacent to and in the opening to cover the opening and create a wall between the high and low pressure chambers.

5. A casing according to claim 4, wherein the opening is formed at least one of by drilling and through injection molding of the casing.

6. A casing according to claim 1, wherein the casing is formed from a thermoplastic injection molded resin.

7. A casing according to claim 4, wherein the thermoplastic injection molded resin includes one of Acrylonitrile butadiene styrene (ABS), polyethylene, polyamide (PA), Polybutylene (PB), Polybutylene terephthalate (PBT), Polycarbonate (PC), Polyester (PEs), Polyethylene (PE) Polyethylene terephthalate (PET, PETE), Polyimide (PI), Polylactic acid (PLA) Polyoxymethylene (POM), Polyphenyl ether (PPE), Polypropylene (PP), Polytetrafluoroethylene (PTFE), Polyurethane (PU), Polyvinyl chloride (PVC), Polyvinylidene chloride (PVDC), or Nylon.

* * * * *